US005465594A

United States Patent [19]

Imboden et al.

[11] Patent Number: 5,465,594

[45] Date of Patent: Nov. 14, 1995

[54] PANTY GARMENT AND METHOD FOR FORMING SAME

[75] Inventors: Walter H. Imboden, Burlington; Jonathan M. Myers, Winston-Salem; Donald M. Caudle, Lewisville, all of N.C.

[73] Assignee: Sara Lee Corporation, Winston-Salem, N.C.

[21] Appl. No.: 287,542

[22] Filed: Aug. 8, 1994

[51] Int. Cl.[6] ..... A41B 9/08; D04B 11/00; A41C 1/00

[52] U.S. Cl. ..... 66/177; 66/178 R; 2/239; 450/115

[58] Field of Search ..... 66/175, 177, 178 R, 66/189; 2/239, 240; 450/115

[56] References Cited

U.S. PATENT DOCUMENTS

| | | | |
|---|---|---|---|
| 3,176,480 | 4/1965 | Gordon et al. | 66/177 X |
| 3,241,340 | 3/1966 | Knihl | 66/177 X |
| 3,413,842 | 12/1968 | Kuney | 66/177 |
| 3,449,932 | 6/1969 | Fillmore et al. | 66/177 |
| 3,852,827 | 12/1974 | Colbert, Jr. | 66/177 X |
| 3,906,754 | 9/1975 | Sackman | 66/177 X |
| 4,390,999 | 7/1983 | Lawson et al. | 66/177 X |
| 4,729,131 | 3/1988 | Thygesen | 66/177 X |

*Primary Examiner*—John J. Calvert

[57] ABSTRACT

A panty garment, panty hose or the like where the garment is formed from first and second circularly and oppositely configured knit tubes forming a front panty section having a shield shaped configuration and a back panty section having a V shaped configuration contained therein wherein the front and rear panty sections are formed from a multiplicity of yarn courses and the yarns are knit in stitch loop constructions to permit more vertical stretch in the rear panty section than in the front panty section when the garment is worn. Differing stitch loop constructions are utilized for the front and rear panty sections to enable this fit characteristic.

8 Claims, 1 Drawing Sheet

PANTY GARMENT AND METHOD FOR FORMING SAME

BACKGROUND OF THE INVENTION

1. Field of the Invention

This invention relates generally to seamless knit tubular blanks for use in forming a body garment and more particularly to a panty garment and method of forming same wherein front and rear panty sections utilize different stitch loop constructions to create firmer support and greater vertical stretch in the rear portion as compared to the front portion.

2. Description of the Prior Art

It is generally known to fashion knit garments by a change in stitch construction to accomplish various forms of figure fit. This can be done by knitting two circular tubes that can subsequently be joined to form a nether garment and by either tapering the tubular members during the knitting process or cutting and sewing them thereafter to accomplish such fit characteristics. It is also known to form various kinds of foundation garments by cutting and sewing more substantial stretchable fabric into finished garments. In the cut and sew operation, greater fit is achievable than has normally been the case with developing tubular members on circular knitting machines.

On occasion, nether garments formed from a pair of tubular knitted members have been provided with some shaping and stretching characteristics by a change in knitted structure during the knitting operation of the individual tubes. See for example U.S. Pat. No. 3,824,812 disclosing a panty garment where the panty is knitted with less courses at its lateral portions than at its front and rear portions so as to cause the lateral portions to be drawn together wale-wise so that the lower ends of the lateral portions will be above the crotch of the garment.

For the most part, combining a foundation type garment with a panty hose garment that can be shaped during the knitting process to the human form has not been done extensively. It is to that desirable objective that the present invention is directed.

OBJECTIVES AND SUMMARY OF THE INVENTION

With the foregoing in mind, it is an objective of the present invention to provide a panty garment offering more than normal support characteristics and making available superior fit characteristics through the knitting process when the garment is made.

Another objective of the present invention is to provide a panty garment that has a knit construction that provides more vertical stretch in the rear panty section than in the front panty section and provides superior support characteristics for the panty section.

Yet another objective of the present invention is to provide a panty hose garment of the type described wherein the front panty section is knit of a first stitch loop construction and the rear panty section is knit of a second differing loop construction.

It is a further objective of the present invention to provide a panty garment of the type described which can offer a combination of support and fit characteristics heretofore unavailable.

The panty garment comprising the present invention is formed by combining first and second circularly and oppositely configured knitted tubes disposed side-by-side and slit at least along a part of their length and joined to the edges formed by the slitting operation to provide a general front panty section with front panty portions extending downwardly from the waist portion and a general rear panty section with rear panty portions extending downwardly from the waist portion to the joined edges. Lateral portions extend downwardly from the waist portion and each extend between a front panty portion on one side and a rear panty portion on the same side. The oppositely configured tubular knit members when joined form a front panty section containing, as a result of the knitting operation, a shield-shaped configuration and a back panty section having a V-shaped configuration. The front and rear panty portions and the connecting lateral portions have a multiplicity of yarn courses that are knitted so that when the garment is worn, more vertical stretch is experienced in the rear panty section than in the front panty section and significant support is provided in the front panty section.

Thus there has been outlined, rather broadly, and in summary form, the more important features of the invention in order that the detailed description that follows may be better understood and in order that the present contribution to the art may be better appreciated. There are obviously additional features of the invention that will be described hereinafter and which will form the subject matter of the claims appended hereto. In this respect, before explaining several embodiments of the invention in detail, it is to be understood that the invention is not limited in its application to the details of construction and to the arrangement of the components set forth in the following description or illustrated in the drawings. The invention is capable of other embodiments and of being practiced and carried out in various ways.

It is also to be understood that the phraseology and terminology herein are for the purpose of description and should not be regarded as limiting in any respect. Those skilled in the art will appreciate the concept upon which this disclosure is based and that it may readily be utilized as a basis for designing other structures, methods and systems for carrying out the several purposes of the present invention. It is also to be understood that the abstract is neither intended to define the invention of the application, which is measured by the claims, nor to limit its scope in any way.

This summary and these objectives of the invention, along with the various features of novelty which characterize the invention, are pointed out with particularity in the claims annexed to and forming a part of this disclosure. For a better understanding of the invention, its operating advantages and the specific objects attained by its use, reference should be made to the accompanying drawings and descriptive matter in which like characters of reference designate like parts throughout the several views.

DETAILED DESCRIPTION OF THE DISCLOSURE

Figure 3:
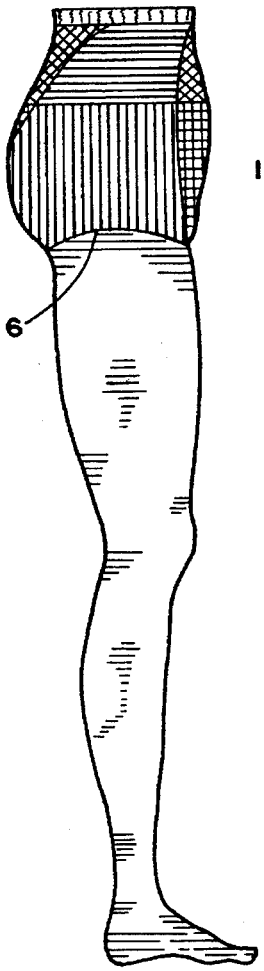
FIG. 3 is a side view of the garment shown in FIG. 1 showing a lateral portion joining the panty front and rear sections.
Figure 1:
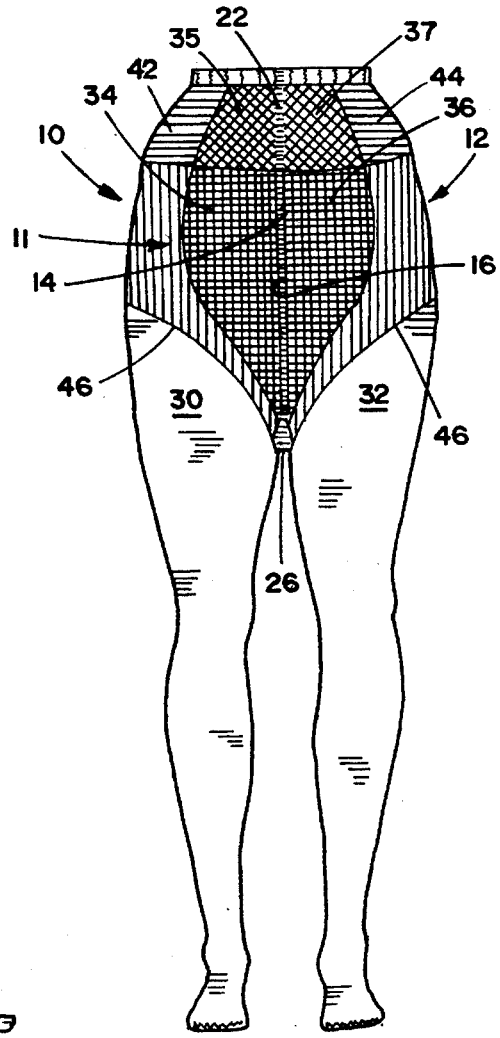
FIG. 1 is a frontal view of the panty garment comprising the present invention as seen on a wearer showing the shield shaped configuration carried by the front panty section.
Figure 2:
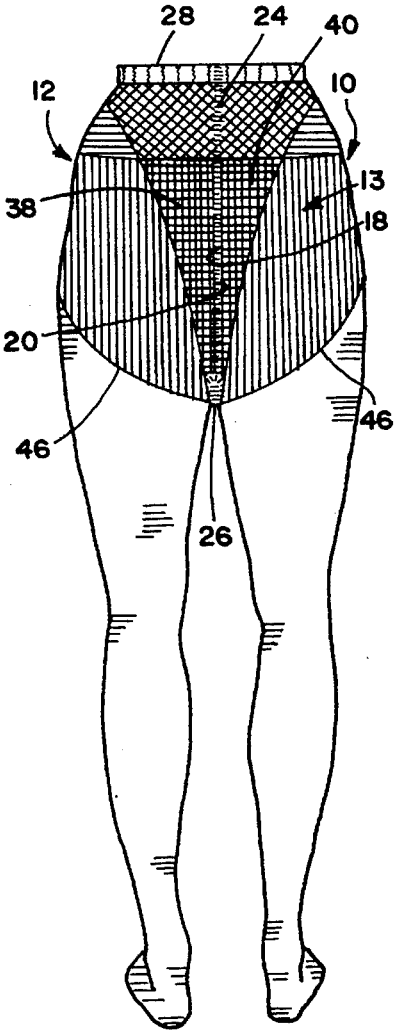
FIG. 2 is a back view of the garment shown in FIGS. 1 and 3 showing the V-shaped configuration formed in the back panty section.

Referring now to the drawings, FIGS. 1–3 illustrate one embodiment of a panty garment incorporating the present invention which includes two circularly knit tubular members 10, 12 with the upper part of each member being slit downwardly to provide an edge 14 along the front of member 10 and an edge 16 along the front of member 12. Edges 18 and 20 are formed in the rear of members 10 and 12 respectively. All edges are joined at a seam 22 designed at the front of the garment and 24 at the rear of the garment. A crotch portion 26 may or may not be included.

An elastic band or turned welt 28 serves as a waist band for the garment. The leg portions 30, 32 extend downwardly from the lower part of the panty garment.

The joined front portions of tubular members 10, 12 form a front panty section shown generally as 11, and the joined rear portions of tubular members 10, 12 form a rear panty section shown generally as 13. The front panty section includes front panty portions 34, 36 that are formed during knitting to extend downwardly from waist band 28 in an S-shape to the joined edges 14, 16 where they connect with the crotch portion 26 when it is used. Thus the two knitted front panty portions of the oppositely configured knit tubular members 10, 12 form a shield-shaped configuration as shown in FIG. 1.

Rear panty section 13 includes rear panty portions 38, 40 that extend downwardly from waist band 28 to joined edges 18, 20 at crotch portion 26. When rear panty portions 38, 40 of tubular members 10, 12 are sewn along their edges 18, 20, they form a V-shaped configuration in rear panty section 13 as shown in FIG. 2.

Front panty section 11 and rear panty section 13 of the garment are connected on each side by lateral portions 42, 44 that extend downwardly from waist band 28. Lateral portions 42, 44 are actually a part of a finger band that extends from waist band 28 and downwardly for a distance around the entire upper part of the garment including the upper part of the shield-shaped configuration formed by front panty portions 34, 36. The density of the garment in this area is changed because of the additional yarns included to form the upper part of the shield configuration within the finger band.

A defined panty portion with sculptured lower edges 46 is provided in a conventional manner, for example like that shown in U.S. Pat. No. 4,010,627. A denser yarn is used in the defined panty so that the panty portion appears as a distinctive part of the garment. Such effect can be accomplished by utilizing through the defined panty portion a regular repeating pattern of reinforced loops with the outermost reinforced loops defining the respective guide or contoured edge 46. In addition, regularly repeating tuck loops may provide a mesh appearance to the defined portions and offer a visually detectable different appearance from the stitch loop construction of, for example, the leg portions 30, 32 which are formed of plain jersey stitch loops. Accordingly, the present garment has essentially sheer light yarn in the leg portions 30, 32, a greater denser yarn in the defined panty portion, an even greater denser yarn in the fingerband portion, and yet a still even greater denser yarn in the shield-shaped configuration in the front panty section and the V-shaped configuration in the rear panty section.

In a typical embodiment of the present invention knit on a multifeed ladies' hosiery circular knitting machine, the first and third courses of the top portion of the garment may contain 70/34 textured yarn and 140 single covered 40/13 textured yarn while the second and fourth courses include 20 denier spandex single covered with 18/8 yarn. The defined panty area may contain in courses one and three 20/7 flat yarn and 140 single covered 40/13 textured yarn while courses two and four will carry 20 single covered 18/8 yarn.

The shield and V-shaped configurations will carry, in addition to other yarns passing through this area, on courses one and three, 20/7 flat yarn and 140 single covered 40/13 textured yarn while on courses two and four 20 single covered 18/8 yarn and 40/34 textured yarn. The leg portions can vary but an acceptable configuration would be 20/7 flat yarn on courses one and three and 20 single covered 18/8 yarn on courses two and four.

Providing a mesh fabric in the upper part of front panty portions 34, 36 by the use of a regularly repeating pattern of tuck loops tightens the stitch configuration thereby restricting vertical stretchability in the front part of the garment while allowing more vertical stretch to be experienced in the rear panty section thereby providing better fit characteristics.

Other variations of panty garments may be made using the present inventive concept such as girdles, panty dresses and the like. The use of a different stitch loop construction in the front from the back thus makes the front shorter than the back and provides firm support because of the heavier fabric formed.

In the drawings and specification there has been set forth the best mode presently contemplated for the practice of the present invention, and although specific terms are employed, they are used in a generic and descriptive sense only and not for purposes of limitation, the scope of the invention being defined in the claims.

What is claimed is:

1. A panty garment having a panty and a waist portion comprising first and second circularly and oppositely configured knit tubes disposed side-by-side and slit at least along part of their length and joined at pairs of the edges thus formed to provide a front panty section with front panty portions extending generally downwardly from the waist portion to the joined edges and a rear panty section with rear panty portions extending downwardly from the waist portion to the joined edges, and lateral portions extending downwardly from the waist portion and each extending between a front portion on one side and a rear portion at that side, the oppositely configured knit tubes, when joined, forming a front panty section having a first shaped configuration and a back panty section having a different shaped configuration, the joined panty front and rear portions and the joined lateral portions having a multiplicity of courses of knitting, the yarns of the multiplicity of courses of the front and back panty portions being knit of different stitch patterns so that more vertical stretch is experienced in the rear panty section than in the front panty section when the garment is worn wherein the front panty portions extend generally in an S-shaped downwardly from the waist portion to the joined edge and wherein the rear panty portions extend downwardly and generally arcuately from the waist portion to the joined edges.

2. The panty garment as claimed in claim 1 wherein the yarns of the multiplicity of courses of the front panty section are knit of a first stitch loop construction.

3. The panty garment as claimed in claim 2 wherein the first stitch loop construction comprises a regularly repeating pattern of tuck loops.

4. The panty garment as claimed in claim 1 wherein the yarns in the multiplicity of courses of the rear panty section are knit of a second stitch loop construction.

5. The panty garment as claimed in claim 4 wherein the second stitch loop construction comprises a regularly repeating pattern of jersey loops.

6. A panty garment as claimed in claim 1 further comprising leg and feet portions extending from the front and rear panty portions to form a panty hose garment.

7. A panty garment as claimed in claim 1 wherein the front panty portions extend generally in an S-shaped downwardly from the waist portion to the joined edges.

8. A panty garment as claimed in claim 1 wherein the rear panty portions extend downwardly and generally arcuately from the waist portion to the joined edges.

* * * * *